United States Patent [19]

Stephens

[11] 4,125,364

[45] Nov. 14, 1978

[54] HIGH VELOCITY BILLET HEATER

[75] Inventor: Wilbur E. Stephens, Redwood City, Calif.

[73] Assignee: Alumax, Inc., San Mateo, Calif.

[21] Appl. No.: 785,520

[22] Filed: Apr. 7, 1977

Related U.S. Application Data

[63] Continuation of Ser. No. 669,239, Mar. 22, 1976, abandoned.

[51] Int. Cl.[2] ..... F27B 9/22; F27B 9/40

[52] U.S. Cl. ..... 432/145; 432/149; 432/196; 266/87

[58] Field of Search ..... 432/145, 149, 194, 196, 432/49, 50, 8, 9, 18, 11, 146; 266/249, 251, 252, 261, 87

[56] References Cited

U.S. PATENT DOCUMENTS

| | | | |
|---|---|---|---|
| 2,441,474 | 5/1948 | Deitrich | 432/225 |
| 2,540,806 | 2/1951 | Berger, Jr. | 432/194 |
| 2,625,387 | 1/1953 | Hess | 432/18 |
| 2,691,515 | 10/1954 | Nesbitt | 266/87 |
| 3,022,056 | 2/1962 | Dailey, Jr. | 432/45 |
| 3,023,478 | 3/1962 | Boyles | 432/196 |
| 3,172,647 | 3/1965 | Remmey | 432/145 |
| 3,539,100 | 11/1970 | Scanlon et al. | 432/50 |
| 3,690,626 | 9/1972 | Vernazza | 432/49 |
| 3,726,515 | 4/1973 | Knaak | 432/9 |
| 3,813,209 | 5/1974 | Venetta | 432/11 |
| 3,836,320 | 9/1974 | Hemsath et al. | 432/11 |
| 3,837,794 | 9/1974 | Phillips | 432/8 |
| 3,854,865 | 12/1974 | Fay | 432/149 |
| 3,868,094 | 2/1975 | Hovis | 266/87 |
| 3,969,069 | 7/1976 | Knaak | 432/25 |
| 4,005,981 | 2/1977 | Turnbull | 432/146 |

*Primary Examiner*—Henry C. Yuen

*Attorney, Agent, or Firm*—Limbach, Limbach & Sutton

[57] ABSTRACT

A billet is transported through an improved furnace by convention means and is heated in the furnace by an external burner unit in which fuel and air are combusted together and then injected at a high velocity into a semi-cylindrical chamber of the furnace tangentially to the billet so as to create a hot vortex of gases circulating around the billet along the length of the furnace. The temperature of the hot gas vortex within the furnace is sensed by means of a thermocouple placed close to the billet surface but not in contact with it so as to sense the temperature of the billet as a function of the temperature of the circulating gas. The temperature of the injected gas is thereby controlled to heat the billet to a desired temperature and then maintain it at that temperature.

3 Claims, 8 Drawing Figures

HIGH VELOCITY BILLET HEATER

This is a continuation of application Ser. No. 669,239, filed Mar. 22, 1976, now abandoned.

BACKGROUND OF THE INVENTION

The present invention relates to a billet heater and more particularly to a furnace for pre-heating a metal billet for a metal extrusion press.

In the extrusion of aluminum billets it is desirable to pre-heat and thus soften the metal to some extend. Prior art devices for carrying out this step have relatively poor thermal efficiency. This is due to the design of the interior contour of the chamber and the method of thermal energy transfer which is limited by a short contact time between the billet and the combustion gases and by the low velocity of the hot gases. In such prior art furnaces the burners are situated within the furnace chamber on both sides of the billet and direct their flames non-tangentially against the underside of the billet. The flames pass only partially around the billet before being exhausted to the furnace exterior. Thus, the flames, although of high temperature, have a low mass velocity and only contact the billet for a short period of time. Thermal efficiency, however, is a function of both the mass velocity of the combusted gases, the length of time the gases are in contact with the billet, and the gas temperature.

Another problem of some prior art aluminum billet heaters is that the temperature maintained within the furnace is controlled by means of a thermocouple which is inserted through the side of the furnace and which contacts the billet as it moves through the length of the furnace. This thermocouple probe develops an aluminum oxide coating from the billet which acts as a thermal insulator and miscalibrates the probe. Still another problem of some prior art billet furnaces is that they are not readily adaptible between oil and gas fuels, but must be specially converted for each one.

SUMMARY OF THE INVENTION

The above and other disadvantages of prior art billet heaters are overcome by the present invention of an improved billet heater of the type having an elongated, heated furnace and means for transporting an elongated metal billet through the length of the furnace wherein the improvement comprises a plurality of combustion units located exteriorly of the furnace chamber and spaced along the length for injecting high velocity, combusted, hot gas into the furnace chamber in a direction generally tangential to the exterior surface of the billet and non-parallel to its length. The interior surface of the furnace chamber has a generally concave shape in cross section taken perpendicular to the length of the chamber so as to create an annular space surrounding the length of the billet whereby a vortex of hot gas is created around the billet to heat it. Because the gas is injected with a high velocity, the billet and the interior chamber wall act as a venturi nozzle to induce and maintain the flow of existing gases in a circumferential flow around the billet. The combined effect of high mass velocity of the gases and extended contact time with the billet provides a rapid and highly efficient method of heat transfer. Exhaust gases are removed from the chamber through ports located at the base of the chamber.

In order to control the temperature of the hot gases injected into the chamber, the temperature of the hot gas circulating around the billet and closely spaced from it is sensed and a control signal is thereby produced to control the temperature of the injected gas. It has been determined that for a given billet size and temperature requirement, the difference in temperature between the billet and the closely surrounding vortex of hot gas is relatively constant. Thus, the temperature of the hot gas can be used to determine the cut-back point for entering a modulated control period to maintain the billet at a specified temperature. By sensing the temperature of the envelope of gases around the billet, the actual billet temperature can thus be sensed without the necessity of contacting it. The thermocouple, therefore, does not develop the oxide coating which would interfere with its function as happens in some prior art devices.

In the preferred embodiment, the hot gases from the combustion chamber are injected into the furnace at velocities of between 100–400 feet per second at temperatures of 800° to 2,000° F. The hot gases are injected tangentially against the billet surface to initiate the vortex of hot gases around the billet.

The hot gas which is injected into the furnace chamber is produced by separately combusting the fuel and air under pressure in a cylindrical chamber situated outside of the billet furnace chamber. In this way, the fuel and air are mixed together in a rapid vortex within the combustion chamber to produce very high temperature gas at a relatively high pressure of 15 - 40 ounces per square inch, gauge. The resulting gas injected into the billet furnace chamber at 100 - 400 feet per second is thus injected at a much higher velocity than the 20 - 60 feet per second for prior art systems.

The temperature of the injected gas can be controlled by a by-pass system which mixes cooler air with the combusted gas prior to its injection into the furnace chamber so as to reduce the temperature of the injected gases below the combustible range of the burner fuel-air system.

It is therefore an object of the present invention to provide a billet heater having improved thermal efficiency.

It is another object of the present invention to provide a billet heater capable of readily adapting to liquid or gaseous fuels.

It is still another object of the present invention to provide a billet heater having improved temperature control sensing means.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENT

Figure 1A:
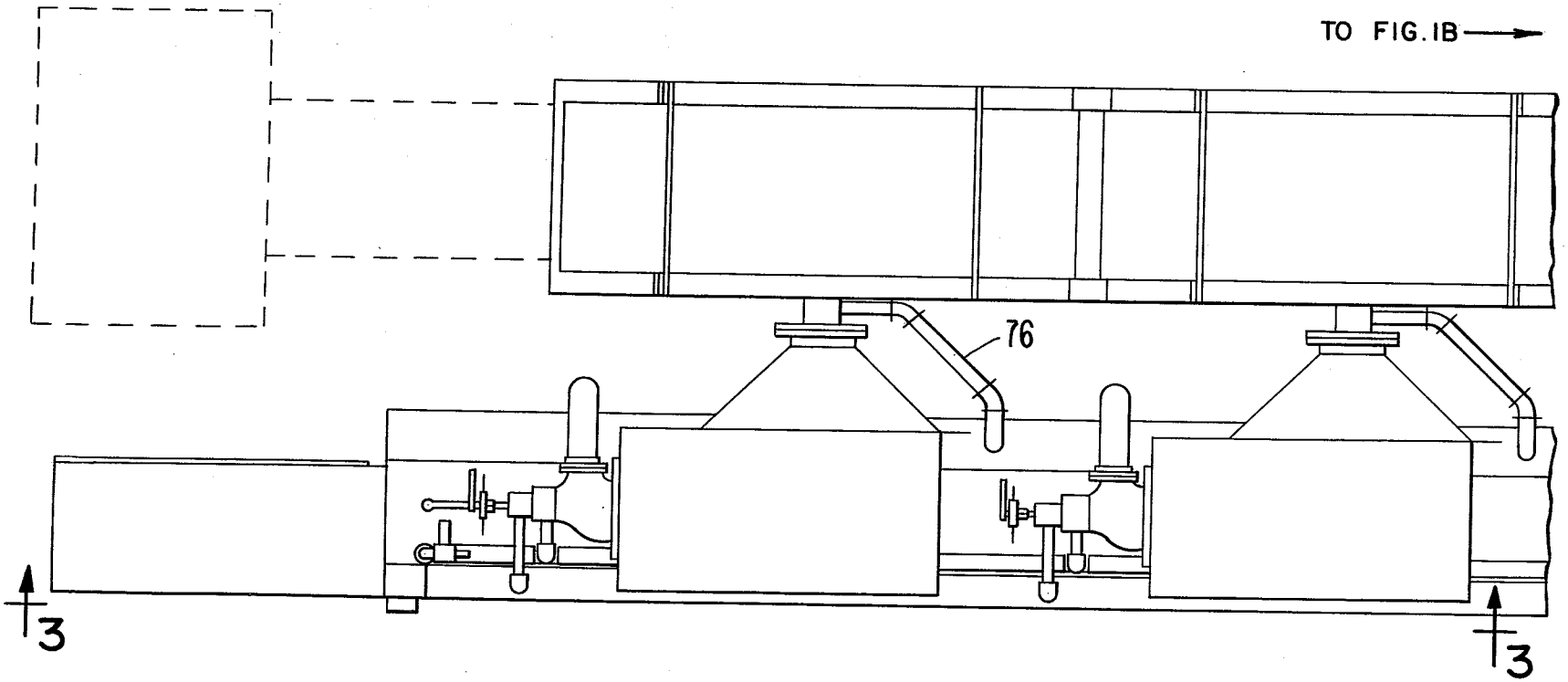
FIGS. 1A and 1B together are a plan view of a billet heater according to the invention, with FIG. 1A showing the left hand end of the billet heater and FIG. 1B showing the right hand end of the billet heater.
Figure 1B:
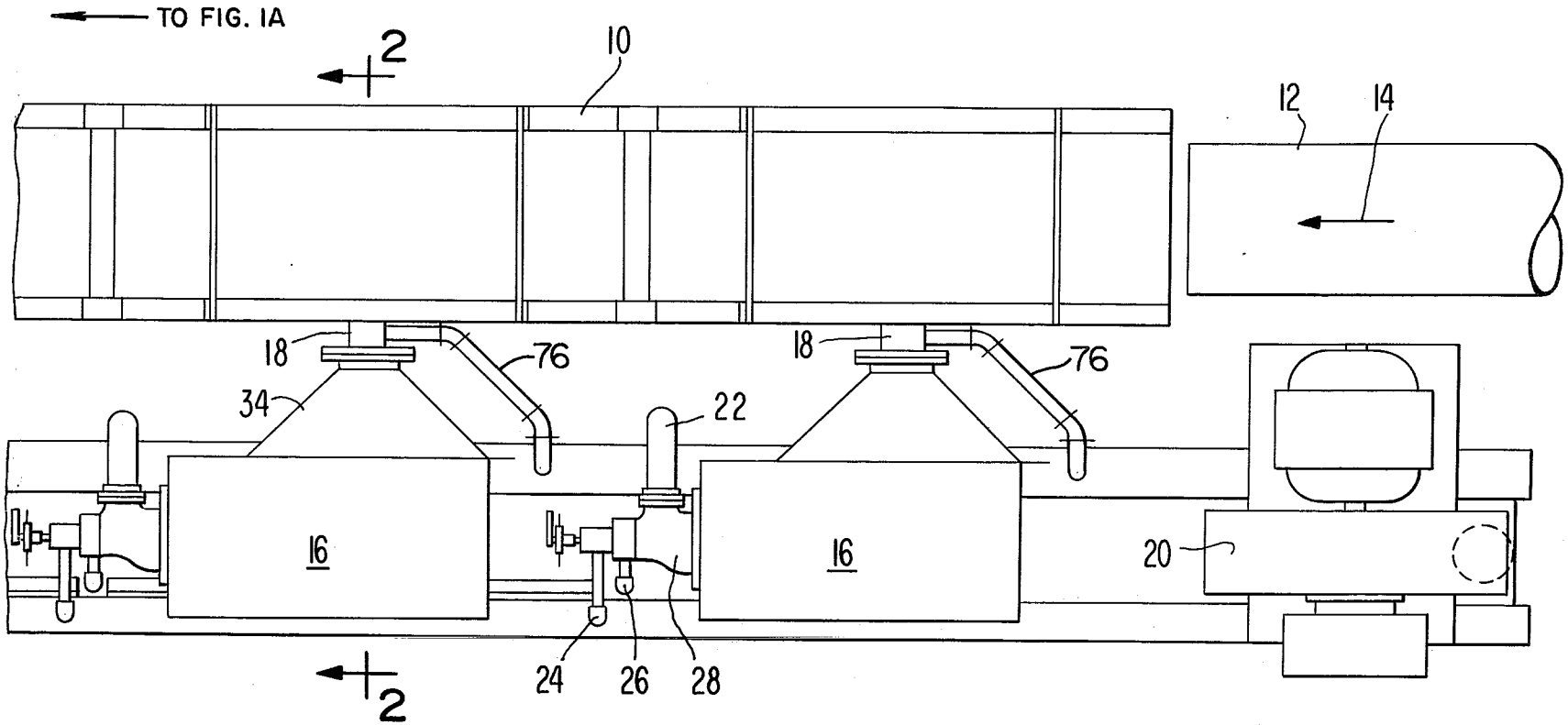
Figure 2:
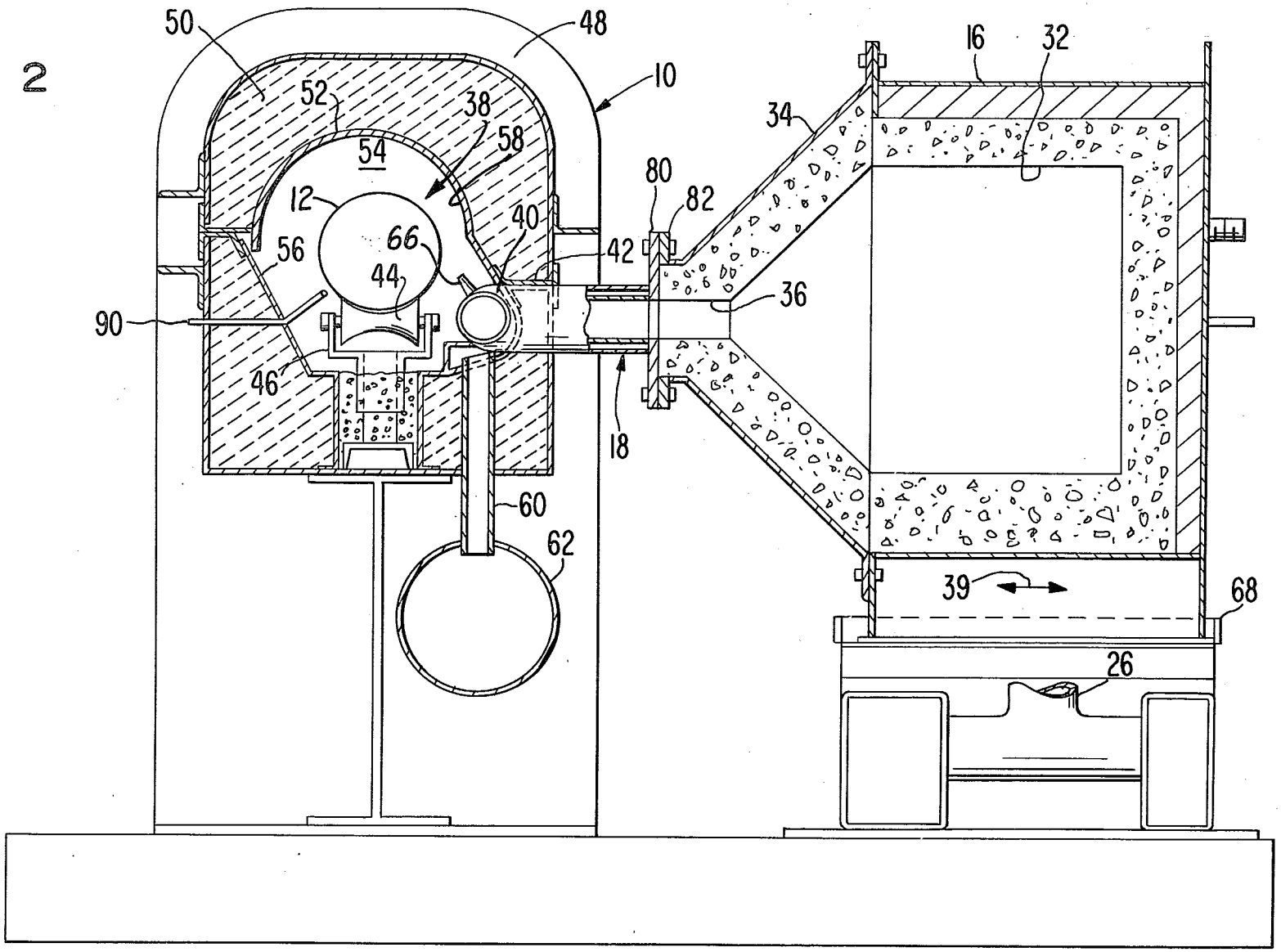
FIG. 2 is an enlarged, vertical view, in section, taken generally along the lines 2—2 of FIG. 1B.

Referring now, more particularly, to FIGS. 1A and 1B and 2, elongated five-zone billet heater 10 is depicted for receiving and heating an elongated, cylindrical aluminum billet 12 advancing in the direction of the arrow 14, that is, from the right to the left of FIGS. 1A and 1B. The billet 12 is transported by conventional mechanisms which therefore will not be described in detail. On the left side of the oven 10, taken with respect to the direction of travel of the billet 12, are located five in line combustion burner units 16, each of which is connected by means of a flanged, coaxial pipe 18 with a nozzle unit 40 in a separate zone of the oven 10. An electric motor powered air blower 20 at one end of the line of burner units 16 feeds all of the burner units 16 with a source of air under pressure. At one side of one of the burner units 16, the left side, as viewed in FIGS. 1A and 1B, air is supplied to the burner unit through a large diameter pipe 22 which is connected through a manifold (not shown) with the main blower 20. The burner unit is also alternatively supplied with liquid fuel in the form of oil through a pipe 24 or with gas through a pipe 26, both of which connect into the burner unit 16 through a bell-shaped member 28 which is attached to the air supply pipe 22 and the input port 30 of the burner unit 16 (see FIG. 3).

The alternative use of fuel oil through the pipe 24 or gas through the pipe 26 is dependent primarily on economic considerations as to which of the two fuels is more readily available and is more economical. The fuel and air mixture is ignited within the bell-shaped member 28 either by an ignition spark mechanism or by a pilot flame and the complete combustion process is carried out within a horizontally cylindrical chamber 32 within the burner unit 16. The pipes 22, 24 and 26 all have flexible sections allowing the burner unit 16 to be moved slightly.

Referring now more particularly to FIG. 2, it can be seen that the side of the burner unit 16 which faces the oven 10 has a conically shaped portion 34 tapering to an exhaust port 36. The exhaust port 36 of the burner 16 is connected by means of the pipe 18 to a hot gas injection nozzle unit 40 situated within the furnace chamber 38 of the oven 10.

The nozzle unit pipe 18 is extended through the side of the wall of the oven 10 through a port 42. The nozzle 40 may be moved laterally with respect to the interior of the furnace chamber 38 to accommodate different sized billets by moving the burner unit 16 relative to the oven 10 as indicated by the arrow 39. This is made possible by mounting the burner unit 16 on a horizontal support 68 which is wider than the base of the burner unit 16. As can be seen in FIG. 2, the billet 12 is supported in the oven 10 by means of a plurality of rollers 44 mounted on supports 46 at the bottom of the oven chamber 38. The rollers 44 are spaced along the length of the oven 10.

The oven 10 is comprised of an outer steel frame 48 which surrounds and supports an inner furnace wall 50 made of refractory material. The upper interior surface 52 of the furnace chamber 38 has a generally semi-cylindrical cross-section taken perpendicular to the length of the furnace 10. Thus, a semi-annular space 54 is formed between the surface of the billet 12 and the upper interior surface 52 of the oven 10. The portion of the furnace wall 56 extending below the midline of the billet 12 to the jack 46 is generally straight and slopes inwardly. This furnace wall 56 is on the left side of the billet as viewed in FIG. 2. The corresponding opposite side of the chamber has a vertical wall 58 which is straight and slopes downwardly towards the nozzle unit 40. In this way, the actual space around the billet 12 assumes an almost tapered, oval cross section with the nozzle 40 being in the narrowest part of the oval. Beneath the nozzle 40 is a downwardly extending pipe 60 leading to an enlarged horizontal manifold 62 which together carry away the exhaust gases from the furnace interior 38.

Figure 5:
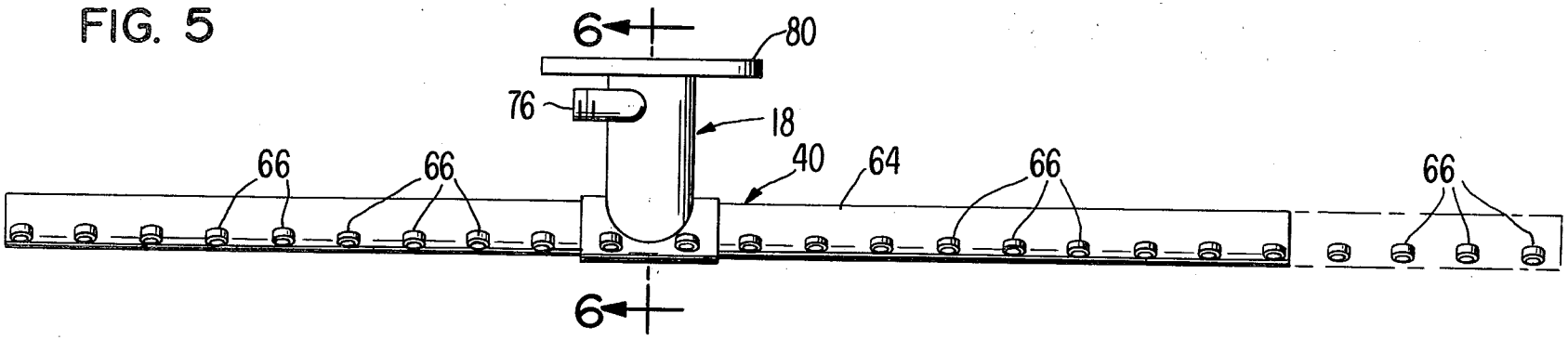
FIG. 5 is an enlarged, plan view of the furnace nozzle unit of the embodiment depicted in FIGS. 1A and 1B.
Figure 6:
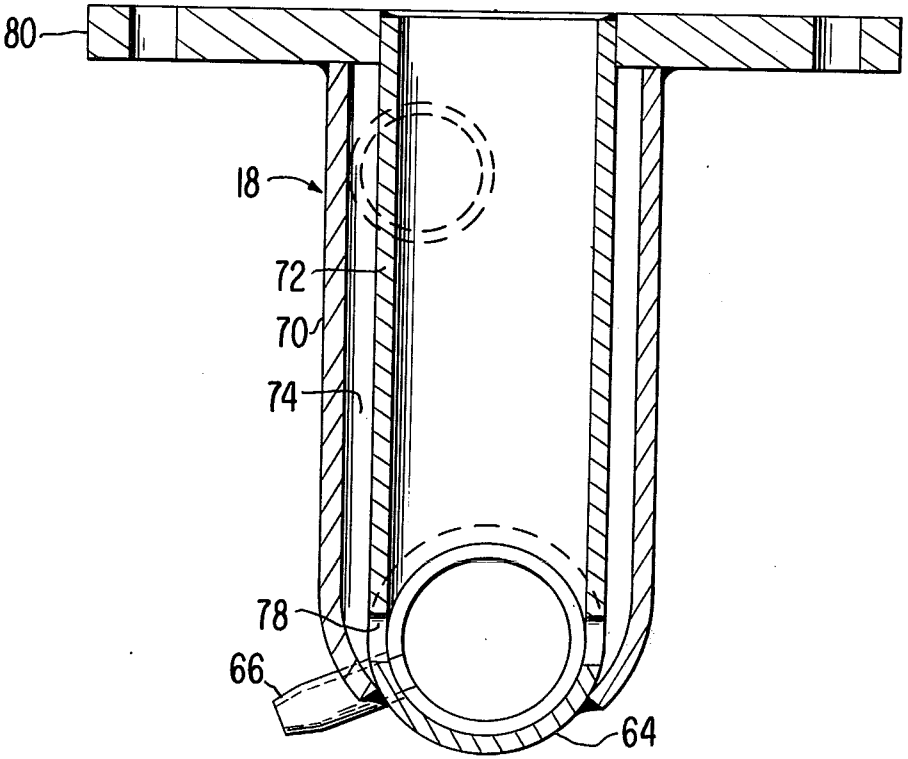
FIG. 6 is an enlarged, vertical view in section, taken generally along the lines 6—6 of FIG. 5.
Figure 7:
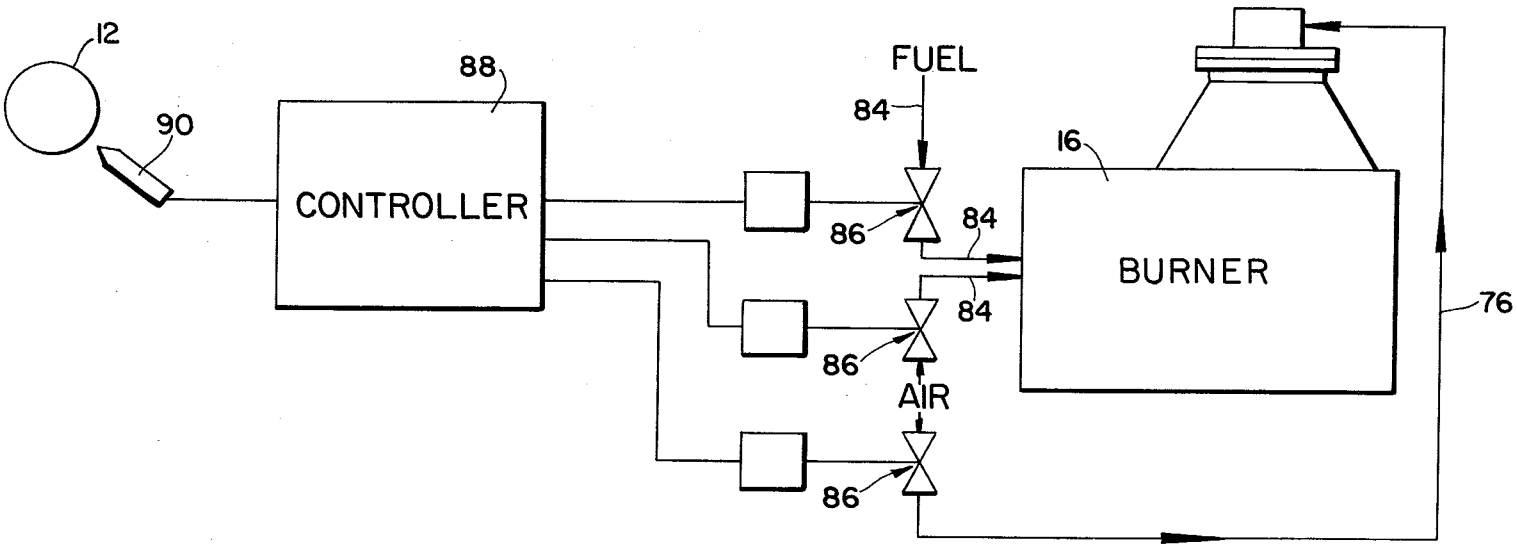
FIG. 7 is a diagram of burner control system.

Referring now more particularly to FIGS. 5 and 6, it can be seen that the nozzle unit 40 is actually a T-shaped pipe with the short, stem pipe 18 being connected to the midpoint of a long horizontal pipe 64 extending along the length of one of the oven sections. Projecting upwardly from the pipe 64 are a plurality of nozzle jets 66 at spaced intervals along the length of the horizontal pipe 64. The jets are inclined upwardly from the horizontal by approximately sixty eight degrees to point toward the billet 12 and direct the hot gases exiting from the jet tangentially to the billet surface 12.

The pipe 18 connects the nozzle unit 40 to a vertical flange 80 which, in turn, is bolted to a corresponding flange 82 of the burner unit 16. The pipe 18 is made of a pair of coaxial, schedule 40 alloy pipes 70 and 72 so that space 74 exists between the two pipes 70 and 72. The inner pipe 72 communicates with the horizontal pipe 64 so that the hot combustion gases from the burner unit 16 are thus conveyed to the nozzle jets 66. It should be noted that the nozzle jets 66 have an oval shaped opening with the long axis of the oval being parallel to the axis of the billet 12.

A pipe 76 communicates with the space 74 between the pipes 70 and 72. The inner pipe 72 is supplied with ports 78 which allow communication between the space 74 and the inner pipe 72. Additional, by-pass air can be introduced through the pipe 76 from the main blower to thereby further control the temperature of the gases exiting from the nozzle jets 66. This air can be used to further reduce the temperature of the injected gas into the oven 10 to a temperature below the combustion temperature within the burner unit 16. As will be explained further hereinafter, the temperature of the injected gas can also be controlled by controlling the amount of the fuel-air mixture in the burner unit 16.

Figure 4:
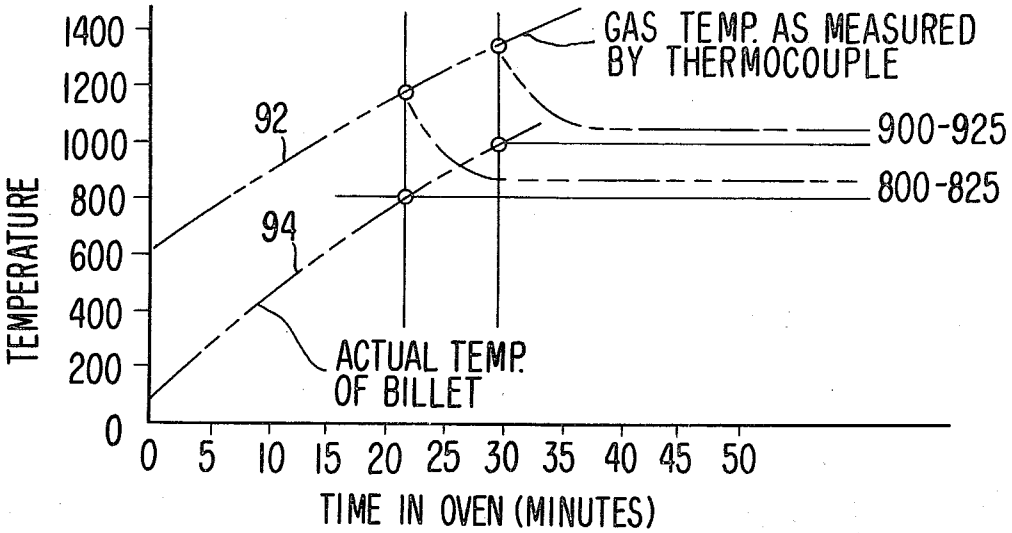
FIG. 4 is a graph depicting the rise in temperature of the billet and the gas within the furnace with respect to time.
Figure 3:
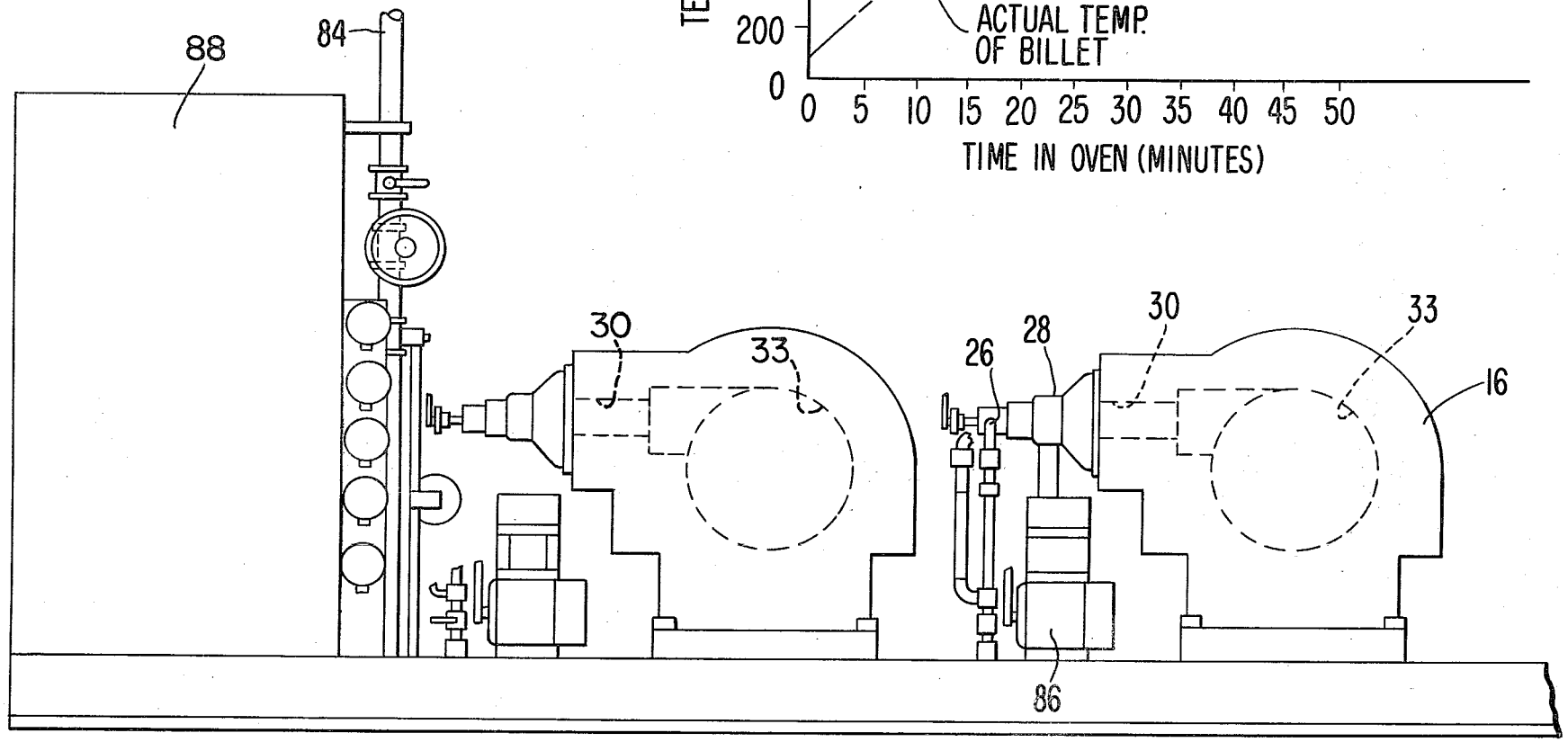
FIG. 3 is a vertical view, with portions broken away, taken generally along the lines 3—3 of FIG. 1A.

Referring now more particularly to FIGS. 2, 3 and 4, the main supply of fuel is supplied through one or more lines 84 which connect with all of the burner units 16 through an assortment of individual, servo valves 86. The servo valves 86 are controlled, in part, by a master controller 88. The details of the master controller 88 will not be discussed since such controllers are well known in the art. A separate thermocouple probe 90 is inserted through each oven section wall to project into the furnace chamber 38. The ends of the thermocouple probes are spaced just slightly away from the surface of the billet 12 and are thus in a position to sense the temperature of the hot gases circulating in a vortex around the surface of the billet 12. By sensing the temperature of the hot gas circulating around and close to the billet, the temperature of the billet can also be determined.

This is possible because the actual temperature of the billet differs from the temperature of the hot gas by a relatively constant amount during the time in which the billet is being heated. This can be seen from FIG. 4 where the upper curve 92 indicates the rise in temperature of the hot gas with respect to the length of time the billet is in the oven. The lower curve 94 parallels the upper curve 92 and represents the actual temperature of the billet as it is being heated. It can be seen that the two curves 92 and 94 are roughly parallel. This sensed gas temperature represented by the curve 92 may be used to control the temperature of the injected gases through the nozzle 66 by metering the amount of fuel and/or air to the combustion unit 16 or by metering the amount of air which is added through the pipe 76 to be mixed with the hot injected gases, or both. The actual metering is done by servo valves 86 under the control of the master control unit 88. The thermocouple 90 is electrically connected to the master control unit 88.

It it is desired to heat the billet to a temperature of, for example, 800° to 825° F., then the combustion burner unit 16 is activated to inject hot gas into the oven at a rate of at least 100 feet per second until the sensed gas temperature circulating close to the billet surface reaches a temperature of approximately 1200° F. At this point, it is known that the billet temperature is approximately 800° F. The master control unit 88 thus automatically modulates the fuel and air supplied to the burner unit 16 to cut back the temperature of the gas injected into the oven to maintain the air temperature at approximately 800° F. This will cause the billet to maintain its temperature at 800°–825° F. It should be noted that all of this control is accomplished without directly contacting the billet 12, thus preventing the thermocouple probe 90 from becoming coated with aluminum oxide which would otherwise interfere with its operation, as happens in some prior art devices.

In practice, in the modulated state, the master controller 88 controls the temperature of the injected gas simply by switching the combustion unit 16 between a high and a low state and by simultaneously controlling the amount of by-pass air supplied to the furnace nozzles through the pipes 76. Once the cut-back temperature is reached at a particular oven section, the controller 88 reduces the fuel-air mixture to the burner unit 16 associated with that oven section from a high burn to a low burn state. The amount of by-pass air through the pipe 76 of that burner unit 16 is then proportionately controlled to maintain the cut-back temperature within the oven section. The fixed by-pass settings and fuel-air settings are such that in the low state with maximum by-pass air the burner unit 16 will just barely not be able to maintain the cut-back temperature within the oven section. In other embodiments, the fuel-air ratio could be proportionally varied to control the temperature.

Because of the high velocity mass transfer of the injected gases together with their high temperature and the venturi effect created by the annular space between the billet 12 and the interior wall 52 of the oven 10, the thermal efficiency of the billet heater according to the invention is quite high compared to conventional units. For example, with a standard billet heater having an oven length of approximately 25 feet and a burner rating of approximately 9 million B.T.U.s per hour, and a production rate with 7 inch diameter billets of 2,100 pounds per hour, then to heat the billets requires 200 B.T.U.s per pound or 420,000 B.T.U.s per hour. A typical fuel consumption for such a furnace would be approximately 5 million B.T.U.s per hour. This works out to a thermal efficiency of approximately 8.4 percent. With the high velocity billet heater of the present invention, for a similarly dimensioned oven and billet, the burner need only have a rating of 3.5 million B.T.U.s per hour and a fuel consumption of only 1,680,000 B.T.U.s per hour. This has a thermal efficiency of approximately 25 percent which greatly exceeds the conventional unit.

In an actual test with an experimental high velocity billet heater according to the invention, a 9 inch diameter billet weighing 250 pounds was heated from a cold start of 50° F. to 850° F. in 26 minutes. The actual fuel consumed was 1.25 gallons. It can be calculated that this required 43,000 B.T.U.s of heat and the fuel consumed was 175,000 B.T.U.s, yielding a thermal efficiency, therefore, of approximately 24.6 percent. With a hot furnace, the efficiency could be expected to be 30–35 percent and the time required to heat the billet would be reduced to about 20 minutes.

It can thus be seen that the high velocity billet heater, according to the invention, is far more efficient than conventional billet heaters and thus uses far less fuel than such conventional billet heaters. A further advantage of the invention is that because of the construction of the combustion burner unit 16, the furnace is easily adaptable to either gas use or oil fuels with no special modifications being necessary.

While in the above described embodiment the thermocouple probes 90 are advantageously spaced from the billet surface, in other less advantageous embodiments the prior art method of using contacting thermocouples may be utilized; however, such thermocouples can be expected to suffer from the problem of becoming coated with aluminum oxide over a period of time.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

What is claimed is:

1. An improved billet heater of the type having an elongated, heated furnace and means for transporting an elongated metal billet through the length of the furnace wherein the improvement comprises:

a plurality of combustion unit means located exteriorly of the furnace and spaced along its length for injecting combusted, hot gas into the furnace chamber at a velocity between 100 to 400 feet per second and at a temperature of at least 800° F. generally tangential to the exterior surface of the billet and non-parallel to its length, and wherein the combustion units each include a cylindrical combustion chamber, a high pressure air supply connected to feed air into the combustion chamber sufficient to produce a pressure of at least 15 ounces per square inch gauge, means for introducing combustible fuel into the combustion chamber in a direction tangential to the interior circumference of the chamber, and nozzle means connected to the combustion chamber for injecting completely combusted high temperature gas from the combustion chamber into the furnace chamber tangentially against the billet, and wherein the interior surface of the furnace chamber has a generally irregular oval shape in a cross-section perpendicular to the length of the chamber to form an annular space surrounding the length of the billet whereby a venturi effect is created by the annular space which wraps a vortex of hot gas around the billet to heat it convectively, wherein the interior of the combustion chamber has a conical taper at the point where it connects to the nozzle means, further comprising means for adjusting the lateral position of the nozzle means with respect to the longitudinal axis of the billet to accommodate billets of different diameters, the billet heater further being of the type in which the fuel and air supplied to the combustion unit means are regulatable in response to a signal from a temperature sensor mounted within the furnace chamber so as to vary the temperature of the hot gas injected into the furnace chamber and wherein the improvement further comprises temperature responsive means mounted within the furnace chamber but closely spaced from the billet for determining the temperature of that portion of the hot gas vortex surrounding the billet which is nearest to the billet's surface and for generating a control signal for regulating the temperature of the hot gas injected into the furnace chamber by controlling the amount of the fuel and air supplied to the combustion unit means.

2. An improved billet heater as recited in claim 1 further comprising means for combining selected additional amounts of air from the high pressure supply with the hot gas from the combustion chamber to control, in part, the temperature of the hot gas injected into the furnace chamber.

3. An improved billet heater as recited in claim 1 wherein the combustion unit means include burner means for selectively burning either fuel oil or gas.

* * * * *